US005445480A

United States Patent [19]

Merriman

[11] Patent Number: 5,445,480

[45] Date of Patent: Aug. 29, 1995

[54] POWER DRILL ACCESSORY

[76] Inventor: Denys J. Merriman, 13359 Rimview Ct., Yucaipa, Calif. 92399

[21] Appl. No.: 288,929

[22] Filed: Aug. 11, 1994

Related U.S. Application Data

[62] Division of Ser. No. 934,796, Aug. 24, 1992, Pat. No. 5,359,821.

[51] Int. Cl.[6] ..... B23B 45/14

[52] U.S. Cl. ..... 408/87

[58] Field of Search ..... 408/87, 92, 99, 136

[56] References Cited

U.S. PATENT DOCUMENTS

| | | | |
|---|---|---|---|
| 755,528 | 3/1904 | Newton | 408/136 |
| 1,097,709 | 5/1914 | Fosselman | 408/92 |
| 2,709,380 | 5/1955 | Reynolds | 408/99 |

FOREIGN PATENT DOCUMENTS

| | | | |
|---|---|---|---|
| WO91/13728 | 9/1991 | WIPO | 408/136 |

*Primary Examiner*—Steven C. Bishop
*Attorney, Agent, or Firm*—Christie, Parker & Hale

[57] ABSTRACT

A bracing system, useable beneath the habitable structures of mobil homes and manufactured housing to render such structures secure from loss of support due to seismic events, includes a plurality of tubular braces which are connected to chassis beams of the structures and to foundation pads supported at grade at spaced locations below the beams. The braces include pairs of longitudinal beams of fixed length which are pinned at lower ends to the pads and slope in opposite directions upwardly below the adjacent beams to their upper ends. The braces include a telescoping transverse brace pinned at its lower end to a pad and connected to an adjacent beam at its upper end. Each transverse brace is continuously adjustable in length through a selected range of lengths prior to connection between a pad and a laterally adjacent beam, and is fixed at its as-installed length by a pin secured in holes drilled after installation through the concentrically overlapping tubes. A drill adapted for use in height-limited spaces below such structures to drill bolting holes in the chassis beams is also disclosed.

7 Claims, 4 Drawing Sheets

POWER DRILL ACCESSORY

CROSS REFERENCE TO RELATED APPLICATION

This is a division of application Ser. No. 07/934,796 filed Aug. 24, 1992, now U.S. Pat. No. 5,359,821.

FIELD OF THE INVENTION

This invention concerns the structural and procedural aspects of a system for bracing mobil and manufactured housing against loss of support due to earthquakes and other events which otherwise could cause such housing structures to fall off their supporting piers. More particularly, it concerns such aspects of a bracing system which is readily and effectively installable and which accommodates and conforms to the dimensions and geometries of individual usage contexts.

BACKGROUND OF THE INVENTION

The Context of the Invention. Due to the increasing costs of conventional single-family housing, a steadily increasing portion of families in the United States, as well as in other countries, reside in mobil and in manufactured housing structures. Such structures are manufactured in compliance with applicable standards and include a chassis for each housing unit; plural units can be used together in a mated relation to form a single habitable structure. Each unit has a rectangular floor plan, and each unit chassis includes a pair of longitudinal beams which are parallel to each other within the width of the chassis. The units are moved on wheels from their places of manufacture to their sites of use where the wheels often are removed after the units have been supported on independent spaced vertical piers. The piers are installed at the unit usage site, which is substantially permanent, between the chassis beams and the natural or prepared grade surface at the site.

The piers on which mobil and manufactured housing units are supported at their usage sites are effective to provide the requisite vertical support for the housing units. However, earthquakes or other natural events, such as abnormally high winds, can impose lateral load on the pier-supported units of sufficient magnitude to cause the housing units to move off of their supporting piers. Such occurrences present the context of the problem to which this invention is addressed.

Review of the Prior Art

The coastal and other regions of Southern California, and also other places, are recognized as areas where earthquakes, though occurring at unpredictable times, are common. Earthquakes of even modest magnitude can produce ground movements sufficient to cause manufactured housing units to move off their supporting piers, thereby significantly damaging the housing units and rendering them unsuitable, sometimes permanently, for use. As a consequence, an industry has developed to provide supplemental bracing systems which are installable under pier-supported manufactured housing units to provide a unit support arrangement which significantly improves the ability of the unit to remain properly supported above the ground during an earthquake. Such bracing systems also are useful in other places to enable manufactured housing units to remain properly supported when subjected to high wind loads which can be encountered in tornadoes and in hurricanes.

U.S. Pat. No. 5,359,821, of which the present patent is a division, comprehensively describes a supplemental, earthquake resistant bracing system for manufactured housing support arrangements which uses standard components which are readily adapted at a usage site to suit and conform to the particular dimensions encountered at a particular usage site. The components of such a bracing system can be maintained economically in inventory by a licensed installation contractor who can respond promptly and effectively to install the system soon after a decision to install has been made. The drawings and descriptions of U.S. Pat. No. 5,359,821 are incorporated herein by reference as background showing an environment in which the present invention has utility.

The invention provides an effective attachment device for a power drill which enables bolting holes for bracing system components to be drilled readily and efficiently in the longitudinal structural beams forming components of the chassis of a manufactured housing unit, in situations where the persons installing the bracing system must work in height-limited spaces.

SUMMARY OF THE INVENTION

A drilling tool, useful in low height and clearance environments for drilling holes in substantially horizontal lower flanges of structural members, includes a power drill having a body and an output shaft. A right angle drive assembly is connected to the drill output shaft; that drive assembly has a driven output element which is rotatable about an axis normal to the drill output shaft, and a chuck is coupled to the output element for rotation therewith. A fulcrum arm assembly is connected to a sleeve located between the drill body and the angle drive assembly. The fulcrum arm assembly defines a fixed fulcrum point at a selected location which is displaced a selected distance laterally toward the drill body from the axis of rotation of the bit chuck and which is adjacent to the bit chuck.

DESCRIPTION OF THE DRAWINGS

The above mentioned and other features of this invention are more fully set forth in the following description of a presently preferred embodiment of the invention which description is presented with reference to the accompanying drawings, wherein.

DESCRIPTION OF THE ILLUSTRATED EMBODIMENTS

Figure 1:
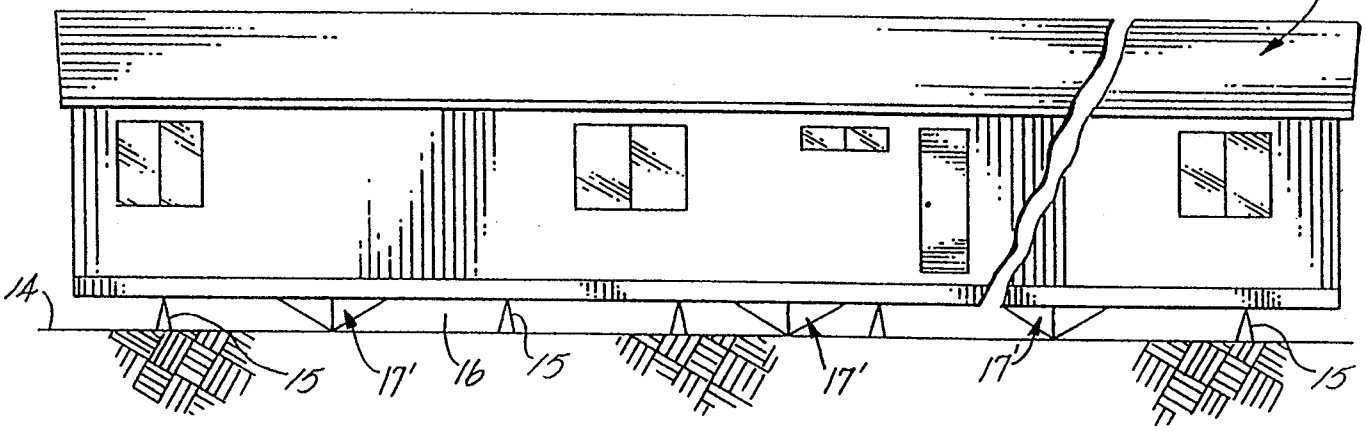
FIG. 1 is an elevation view of a manufactured housing structure supported on piers to define a crawl space within which is installed a bracing system.
Figure 2:
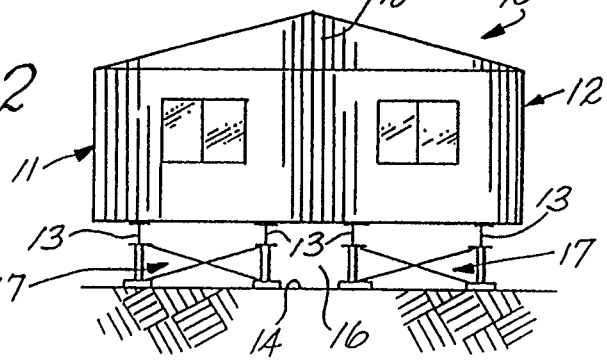
FIG. 2 is an end elevation view of the housing structure shown in FIG. 1.

FIGS. 1 and 2 are side and end elevation views of a habitable structure 10 useful as a single family dwelling, for example. As shown best in FIG. 2, structure 10 is composed of mated individual manufactured housing units 11 and 12. A two-unit manufactured housing structure is selected as the environment within which the present invention is useful.

As shown in FIG. 2, each housing unit 11, 12 has a supporting chassis which includes, as principal components, a pair of structural beams 13 which are disposed parallel to each other at spaced locations across the width of the unit. The beams extend over the full length of the unit which can be as long as 66 feet in extent. Each housing unit is supported above an adjacent supporting surface 14, called "grade", on a plurality of piers 15 which are engaged between each chassis beam 13 and grade at suitably spaced locations along the beams. As so supported on the piers 15, each housing unit provides below it a crawl space 16 which has a height between grade the chassis beams which typically is in the range of from 20 to 27 ½ inches, although crawl spaces of lower height are not uncommon.

An earthquake resistant bracing system (ERBS) 17 is installed in the crawl space 16 beneath each of housing units 11 and 12 between grade and chassis beams 13. ERBS system 17 secures the vertical supports for the housing units from overturning or collapse during earthquakes or other potentially damaging natural events.

Figure 3:
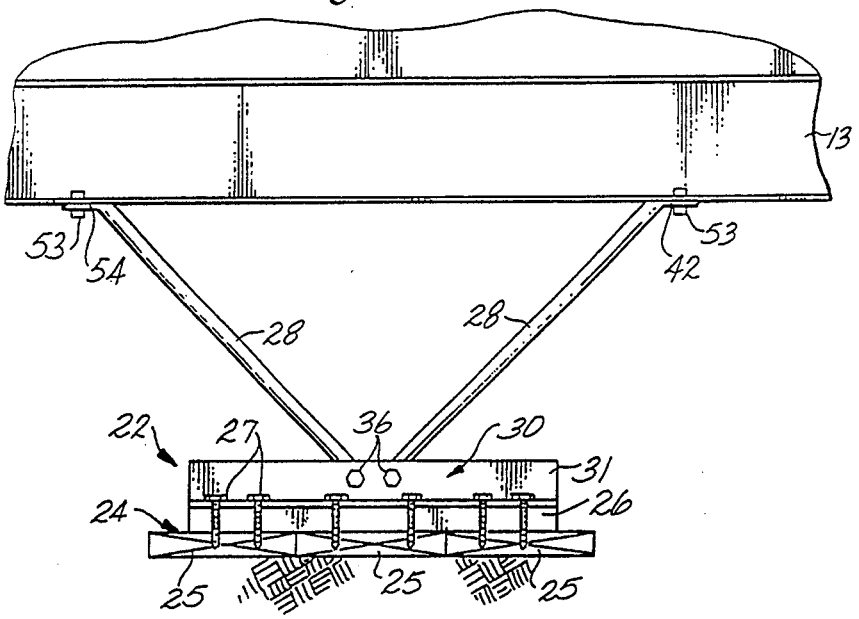
FIG. 3 is an elevation view of longitudinal brace components of the bracing system.
Figure 4:
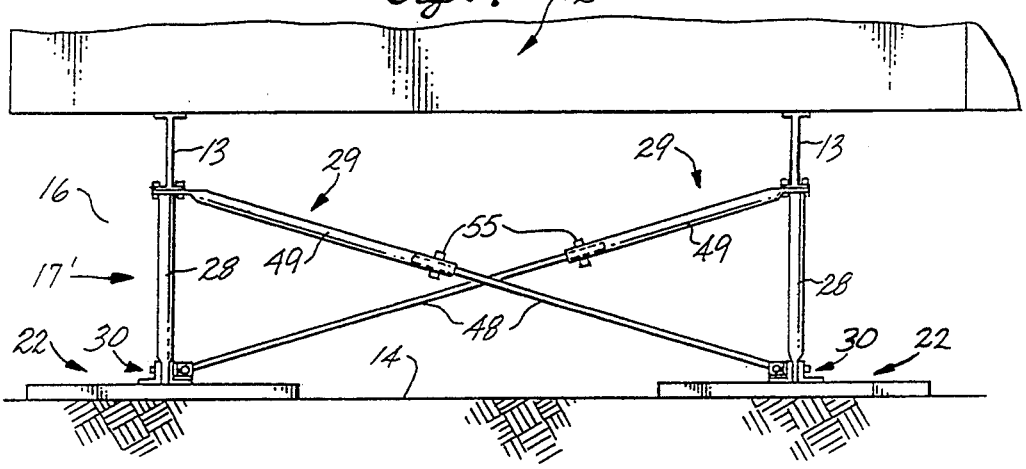
FIG. 4 is an elevation view of transverse brace components of the bracing system.

The structural features of an ERBS subsystem 17' adapt their components to installation by an effective and efficient procedure which comprises the following principal steps: 1) establishing a foundation pad at grade at each of at least a pair of spaced locations below and along each housing unit chassis beam; 2) pinning to, each foundation pad, at lower ends thereof, a pair of longitudinal braces which have predetermined length; 3) bolting the upper ends of the longitudinal braces to the corresponding chassis beam at locations spaced in opposite directions along the beam from the foundation pad below that beam; 4) pinning to each foundation pad the lower end of the two-part telescopically length-adjustable transverse brace assembly associated with that pad; 5) bolting the upper end of each transverse brace assembly to the other chassis beam at a location which is substantially opposite the lower end of that transverse brace assembly; and 6) fixing each transverse brace against axial movement of its two telescopically engaged parts relative to each other after connection of the brace lower and upper ends, respectively, to the foundation pad and the other chassis beam. The installation process includes performing, at appropriate times, the additional step of adjusting the angle of deviation of the upper connection tabs of the braces, preferably at the site of installation, so that the tabs lie substantially parallel to the chassis beam undersides thereby to conform to the actual crawl space height as encountered at the various locations where the braces are to be connected to the housing unit chassis beams. A further step is drilling through the chassis beams, at locations determined by the adjusted positions of the brace upper end connecting tabs, the necessary holes to enable the brace upper ends to be bolted to the chassis beams by use of machine bolts which preferably are 1/16" undersize relative to the holes formed in the brace upper end tabs. The bolting holes for the chassis beam connections shown in FIGS. 3 and 4 can be drilled conveniently and efficiently by use of the low clearance drilling tool which is shown in FIGS. 5–7 and which is described below.

The efficiencies of the structural and procedural aspects of the ERBS system described above are such that an experienced three man team can install the system under two 66 foot long manufactured housing units in four to five hours. That installation time is very short compared to the time required to install the known earthquake resisting bracing systems described above. Also, the costs of the components of ERBS system 71 are substantially less than the costs of the components of the known systems described above, due principally to the standardization of components of system 71 and their capability of being adjusted at the site to conform to the dimensional requirements of specific installation situations.

Figure 5:
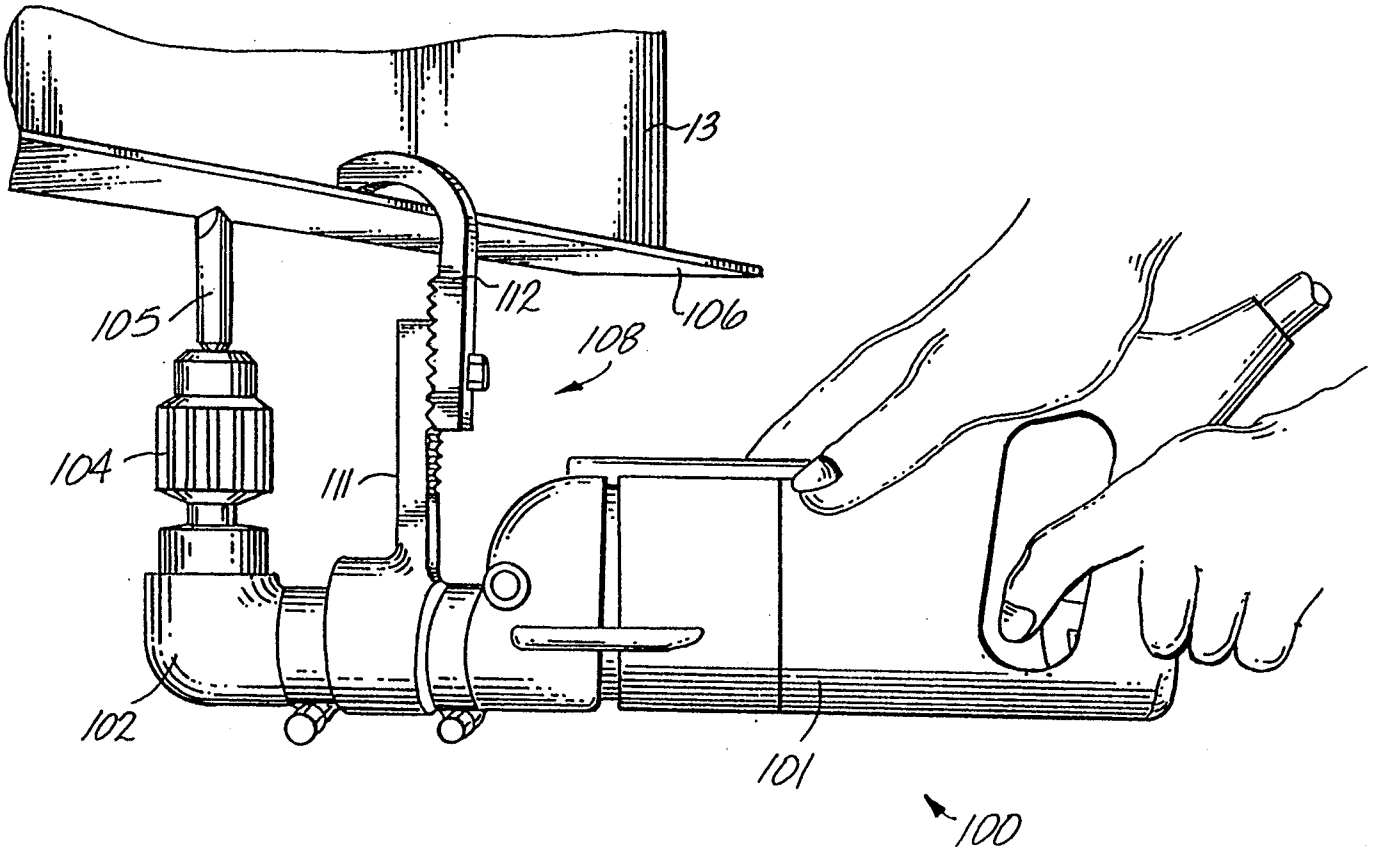
FIG. 5 is an elevation view showing an improved drilling tool according to this invention which is useful to efficiently drill bolting holes in housing unit chassis beams from within the limited height crawl space afforded below a supported manufactured housing structure.
Figure 6:
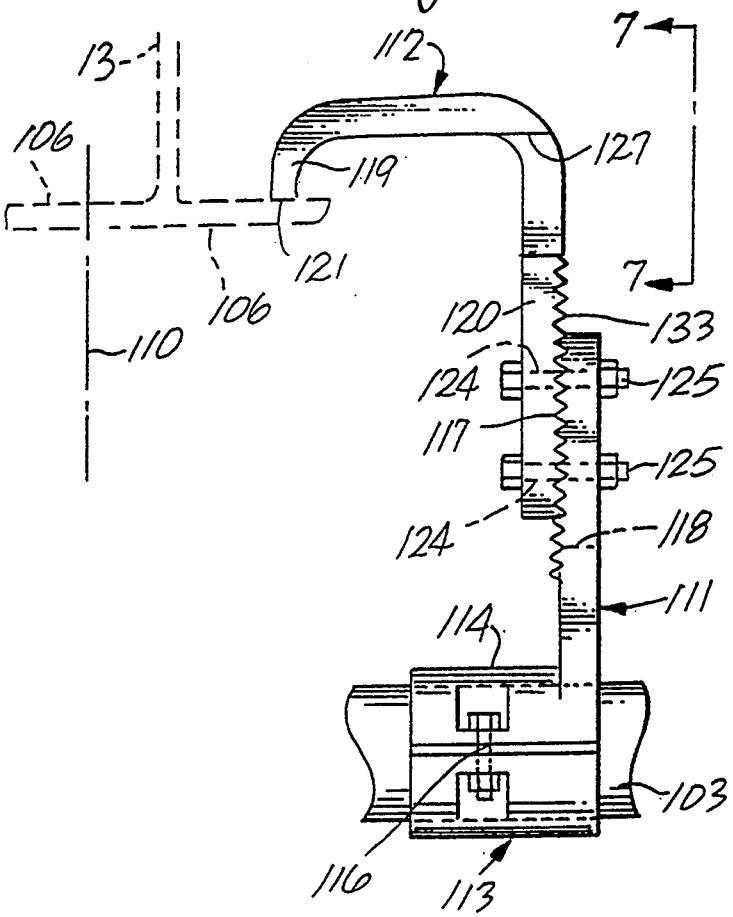
FIG. 6 is an elevation view of a component of the drilling tool shown in FIG. 5.
Figure 7:
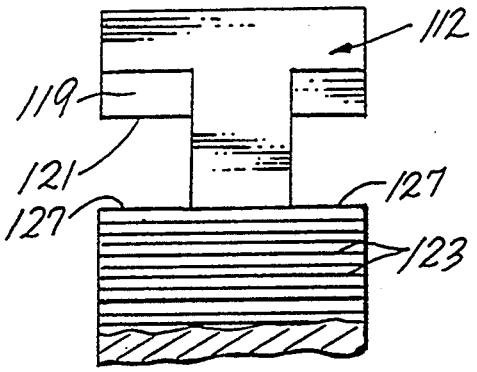
FIG. 7 is a fragmentary elevation view taken along line 7—7 of FIG. 6.

FIGS. 5, 6 and 7 illustrate a drill assembly 100 which was been developed for use in low clearance environments, such as a crawl space 16, to readily and efficiently drill in the bottom flanges of manufactured housing unit chassis beams the holes required for connection of the longitudinal and transverse braces of an ERBS subsystem 17' to the beams. The drill is composed of a heavy duty, preferably electrically powered drill 101 of the type which is typically used by plumbers and which has a right angle drive 102 carried at one end of a cylindrical housing 103 (See FIG. 6) of a drill shaft extension assembly, the other end of which is connected to drill 101. A chuck 104 is carried by the output shaft of the right angle drive for receiving a drill bit 105 which preferably is a unfluted drill bit of the appropriate diameter for drilling the desired holes in the bottom flanges 106 of a housing unit chassis beam 13 which, in the instance shown in FIG. 5, is of I beam configuration. An adjustable fulcrum assembly 108, shown in detail in FIGS. 6 and 7, is clamped around drill shaft extension housing 103 and is disposed substantially parallel to the axis of the output shaft of right angle drive 102. That axis is represented in FIG. 6 by line 110.

As shown in FIG. 6, fulcrum assembly 108 is composed principally of an arm member 111, a hook member 112 of substantially "J" configuration in elevation, and a clamp member 113. The clamp member is semi-circular to define one half of a circularly cylindrical sleeve, the other half of which is defined by a cooperating semi-circular clamp portion 114 at one end of arm member 111. The opposing semi-circular cylindrical surfaces of clamp member 113 and of arm clamp portion 114 have the same radius of curvature as the outer surface of shaft extension housing 103. Clamp member 113 and clamp portion 114 are engaged in secure clamping relation to the exterior of shaft extension housing 103 by a pair of bolts 116, one of which is shown in FIG. 6. The head of the bolt, and the nut which cooperates with the bolt, are disposed in suitable recesses formed in the exterior of the clamp member and the arm clamp portion. When arm 111 is clamped to drill 101, the elongate portion of arm member 111 lies normal to the drill shaft, i.e., parallel to the axis 110 of rotation of drill bit 105.

At its end opposite from clamp portion 114, the surface of arm 111 which faces toward the drill bit axis 110 is contoured to define a series of regularly spaced teeth 117 which extend across the width of that arm surface along lines which are perpendicular to the length of the arm. A slot aperture 118 is formed through the arm parallel to its length in that portion of its length which is covered by teeth 117.

The "J" shaped hook member 112 has a short leg 119 and a long leg 120. Short leg 119 has a tip 121. The outer surface of long leg 120 (the surface of the leg which faces away from short leg 119) is contoured to define a plurality of transverse teeth 123 which mate with the teeth 117 defined by arm member 111. A pair of holes 124 are drilled through the long leg in the area which defines teeth 123 so that, by use of suitably sized nut and bolt assemblies 125 cooperating in holes 124 and in slot 118, the toothed surfaces of arm member 111 and of hook member 112 can be securely clamped together in a desired adjusted position which locates hook tip 121 a desired distance from the axis of extension housing 103.

As shown best in FIG. 7, the sides of hook member long leg 120 are notched, as at 127, immediately adjacent the return bend portion of the hook member between legs 119 and 120. Notches 127 are so located in the hook member long leg that the tip 121 of short leg 19 is between the ends of the notches.

The spacing between hook member tip 121 and drill bit axis 110 is defined so that when the drilling tool is placed square relative to the web of an I beam chassis beam 13 which is to have a bolting hole drilled in its left lower flange (see FIG. 6), hook member tip 121 is engagable with the top surface of the right lower flange 106 of the beam about the same distance from the beam web as the spacing of the desired hole from the opposite side of the beam web. An upward force on drill bit 105 sufficient to produce efficient penetration of the drill bit through the beam flange is produced by either pushing down on or pulling down on the handle of drill 101 in the manner shown in FIG. 5. When the drill is so used, the short leg 119 of hook member 112 serves as a leverage fulcrum for the effective application of upward force to the drill bit against the beam flange.

When a mounting bolt hole is to be drilled in the right flange of beam 13 (see FIG. 6), drilling tool 100 is positioned so that the axis of extension housing 103 is skew to the length of the beam by an amount sufficient to enable the drill bit to be engaged with the underside of a beam right flange and the tip 121 of the fulcrum assembly to be engaged with the top surface of that same flange at an appropriate location displaced along the length of the flange from the desired position of the drill bit axis. Notches 127 in the base end of hook member long leg 120 afford clearance for the edge of the beam flange in that circumstance. Notches 127 are provided in the opposite edges of leg 120 so that the tool can be turned left or right from a square relation to the beam web.

In light of the foregoing descriptions, it will be appreciated that the height of the crawl spaces in which earthquake resistant bracing systems 17 or permanent foundation bracing systems 60 are to be installed are limited. Limited clearance drill 100 can be used very conveniently in such limited height spaces by a workman lying on his back pulling downwardly on the handle of drill body 101. While tool 100 need not be used to install the bracing systems of this invention in the crawl spaces below manufactured housing units, the use of that tool makes it possible to properly install those systems very efficiently.

Workers skilled in the art to which this invention pertains will appreciate that the foregoing descriptions have been presented with reference to presently preferred embodiments of the invention which have structural and procedural aspects. The preceding descriptions of those presently preferred embodiments of the invention are not intended to be, and are not to be read as an exhaustive catalog of all of the structural and procedural forms which may be used to practice this invention. Modifications and variations upon the structures and procedures described above can be used without departing from the fair inventive scope of this invention. Accordingly, the following claims are not to be interpreted as pertaining only to the structures and procedures which have been described above.

What is claimed:

1. A drilling tool useful in low height clearance environments for drilling holes in substantially horizontal lower flanges of structural members, the tool comprising a power drill having a body and an output shaft, a right angle drive assembly connected to the drill output shaft and having a driven output element rotatable about an axis normal to the drill output shaft and a bit chuck coupled to the output element for rotation therewith, and a fulcrum arm assembly connected to a sleeve located between the drill body and the angle drive assembly and defining a fixed fulcrum point at a selected location displaced from said axis toward the drill body a selected distance laterally from the drill output shaft and adjacent to the bit chuck.

2. A fulcrum arm assembly useful with a power drill having an output shaft housing to which is connectible a right angle drive assembly to be driven by the output shaft, the arm assembly defining at a first end thereof means for affixing the arm assembly to the drill output shaft housing, an opposite end portion of the arm assembly being of J-like configuration having a tip facing substantially toward the first end of the arm assembly.

3. Apparatus according to claim 2 including means for adjusting the distance between the tip and the arm assembly first end.

4. Apparatus according to claim 2 wherein the means for affixing the arm assembly first end to the drill output shaft housing comprises means for clamping the arm assembly to the housing.

5. Apparatus according to claim 2 wherein the arm assembly has side edges spaced laterally from the tip, and a recess in at least one of the edges over a length thereof which spans the location of the tip.

6. Apparatus according to claim 5 wherein the tip and the recess are defined in fixed relation to each other.

7. The drilling tool useful in low height clearance environments for drilling holes in substantially horizontal lower flanges of structural members, the tool comprising a power drill having a body and an output shaft, a right angle drive assembly connected to the drill output shaft and having a driven output element rotatable about an axis normal to the drill output shaft and a bit chuck coupled to the output element for rotation therewith, and a fulcrum arm assembly connected to a sleeve located about the drill output shaft between the drill body and the angle drive assemby and defining a fixed fulcrum point at a selected location displaced from said axis toward the drill body selected distance laterally from the drill output shaft and adjacent to the bit chuck.

* * * * *

UNITED STATES PATENT AND TRADEMARK OFFICE

CERTIFICATE OF CORRECTION

PATENT NO. : 5,445,480

DATED : August 29, 1995

INVENTOR(S) : Denys J. Merriman

It is certified that error appears in the above-indentified patent and that said Letters Patent is hereby corrected as shown below:

On the Title Page, ABSTRACT, delete the ABSTRACT in its entirety and insert therefor -- An accessory for power drills facilitates the drilling of holes in, for example, the bottom flanges of chassis beams of mobile and manufactured housing units in circumstances where access and work spaces are restricted. The drill is equipped with a right angle drive between the chuck and the drill output shaft. A fulcrum arm assembly is connected to a sleeve between the drill body and the angle drive. The fulcrum arm assembly provides a fulcrum point, fixable relative to the sleeve, which is spaced toward the drill body from the chuck rotary axis and which is adjacent the chuck. The fulcrum point can be engaged with the upper surface of a beam flange to be drilled; downward force on the drill body urges a bit in the chuck upwardly toward the flange. --

UNITED STATES PATENT AND TRADEMARK OFFICE

CERTIFICATE OF CORRECTION

PATENT NO. : 5,445,480

DATED : August 29, 1995

INVENTOR(S) : Denys J. Merriman

It is certified that error appears in the above-indentified patent and that said Letters Patent is hereby corrected as shown below:

Column 3, line 38, after "to" delete the comma.

Column 5, lines 20, 21, change "short leg 19" to -- short leg 119 --.

Column 6, line 26, between "located" and "between" insert -- about the drill output shaft --.

Signed and Sealed this

Twenty-sixth Day of March, 1996

*Attest:*

Bruce Lehman

BRUCE LEHMAN

*Attesting Officer*

*Commissioner of Patents and Trademarks*